US009325109B2

(12) United States Patent
Nagashima et al.

(10) Patent No.: US 9,325,109 B2
(45) Date of Patent: Apr. 26, 2016

(54) ELECTRICAL CONNECTOR

(71) Applicant: Tyco Electronics Japan G.K., Kanagawa (JP)

(72) Inventors: Fumito Nagashima, Saitama (JP); Tsutomu Shirakawa, Toyota (JP); Koji Katano, Toyota (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/084,051

(22) Filed: Nov. 19, 2013

(65) Prior Publication Data

US 2014/0141640 A1 May 22, 2014

(30) Foreign Application Priority Data

Nov. 19, 2012 (JP) ..... 2012-252908

(51) Int. Cl.
*H01R 13/627* (2006.01)
*H01R 24/20* (2011.01)

(52) U.S. Cl.
CPC ..... *H01R 13/627* (2013.01); *H01R 13/6272* (2013.01); *H01R 24/20* (2013.01); *H01R 2201/26* (2013.01)

(58) Field of Classification Search
CPC ... H01R 13/627; H01R 13/6272; H01R 24/20
USPC ..... 439/350, 352, 357, 660, 358, 839, 76.1, 439/347, 607.01, 488, 701
See application file for complete search history.

(56) References Cited

U.S. PATENT DOCUMENTS

| | | | | |
|---|---|---|---|---|
| 5,807,119 | A * | 9/1998 | Baechtle et al. | 439/79 |
| 5,967,859 | A * | 10/1999 | Cecil et al. | 439/752 |
| 5,971,788 | A * | 10/1999 | Niitsu et al. | 439/350 |
| 6,361,374 | B1 * | 3/2002 | Lloyd et al. | 439/701 |
| 6,431,896 | B2 * | 8/2002 | Saito et al. | 439/259 |
| 6,840,818 | B2 | 1/2005 | Itou | |
| 6,860,767 | B2 * | 3/2005 | Takahashi et al. | 439/752 |
| 7,179,135 | B2 * | 2/2007 | Osada et al. | 439/752 |
| 7,588,443 | B2 * | 9/2009 | Wu et al. | 439/74 |
| 7,862,951 | B2 * | 1/2011 | Komiyama et al. | 429/468 |
| 8,011,948 | B2 * | 9/2011 | Wu | 439/358 |
| 8,102,673 | B2 * | 1/2012 | Chen | 361/807 |
| 8,157,579 | B2 * | 4/2012 | Wu | 439/352 |
| 8,157,580 | B2 * | 4/2012 | Wu | 439/352 |
| 8,500,493 | B2 * | 8/2013 | Liu et al. | 439/660 |

(Continued)

FOREIGN PATENT DOCUMENTS

| | | | |
|---|---|---|---|
| JP | 2010123488 | A | 6/2010 |
| JP | 1020100058995 | | 6/2010 |
| JP | 2010262853 | A | 11/2010 |
| JP | 2013-187050 | A | 9/2013 |

OTHER PUBLICATIONS

Japanese Office Action, dated Nov. 24, 2015, 3 pages.

(Continued)

*Primary Examiner* — Jean F Duverne
(74) *Attorney, Agent, or Firm* — Barley Snyder

(57) ABSTRACT

An electrical connector is provided and includes a housing and plurality of contacts. The a housing includes a partition wall. The plurality of contacts are alternatively arranged along a plurality of rows in the housing such that adjacent rows of the plurality of rows are separated by the partition wall and offset with respect to each other.

12 Claims, 9 Drawing Sheets

(56) References Cited

U.S. PATENT DOCUMENTS

| | | | | |
|---|---|---|---|---|
| 8,550,848 | B2 * | 10/2013 | Wu | 439/607.18 |
| 8,708,750 | B2 * | 4/2014 | Ho | 439/639 |
| 2013/0236805 | A1 | 9/2013 | Furuya et al. | |

OTHER PUBLICATIONS

Abstract of JP2010123488(A), dated Jun. 3, 2010, 2 pages.

Abstract of JP2010262853(A), dated Nov. 18, 2010, 2 pages.

* cited by examiner

ELECTRICAL CONNECTOR

CROSS-REFERENCE TO RELATED APPLICATIONS

This application claims the benefit of the filing date under 35 U.S.C. §119(a)-(d) of Japanese Patent Application No. 2012-252908 filed Nov. 19, 2012.

FIELD OF INVENTION

The present invention relates to an electrical connector and, in particular, to an electrical connector having housing and contacts alternatively arranged in the housing.

BACKGROUND

An known electrical connector disclosed in Japanese Patent Application No. 2012-051391 is used to connect each of a plurality of laminated cells in a fuel cell.

The known electrical connector of Japanese Patent Application No. 2012-051391 includes a fitting slot along a side of a housing thereof, and when a corner part of fuel cell is fitted into the fitting slot, the plate-shaped cells of the fuel cell are inserted one by one into a plurality of contacts in the housing. The cells arranged with respect to each other at narrow intervals, while the contacts are arranged alternately in two or more rows formed in parallel to the cell arrangement in a zigzag formation such that the positions thereof in the row direction are shifted.

In Japanese Patent Application No. 2012-051391, contact receiving passageways are individually arranged in a zigzag formation like the contacts, and a gap exists between cavity section members that hold the contacts from both sides. Therefore, a cell that is bent slightly when coming into contact with the connector front end may be inserted into the contact in the row adjacent to the corresponding contact through this gap.

SUMMARY

Accordingly, an object of the invention is, among others, to prevent improper fitting of a connector provided with contacts each of which is conducted to each of arranged plates.

The electrical connector includes a housing and plurality of contacts. The a housing includes a partition wall. The plurality of contacts are alternatively arranged along a plurality of rows in the housing such that adjacent rows of the plurality of rows are separated by the partition wall and offset with respect to each other

BRIEF DESCRIPTION OF THE DRAWINGS

The invention is explained in greater detail below by way of example with reference to the appended drawings of which.

DETAILED DESCRIPTION OF THE EMBODIMENT(S)

The present invention will now be described in detail based on an embodiment shown in the accompanying drawings.

Figure 1:
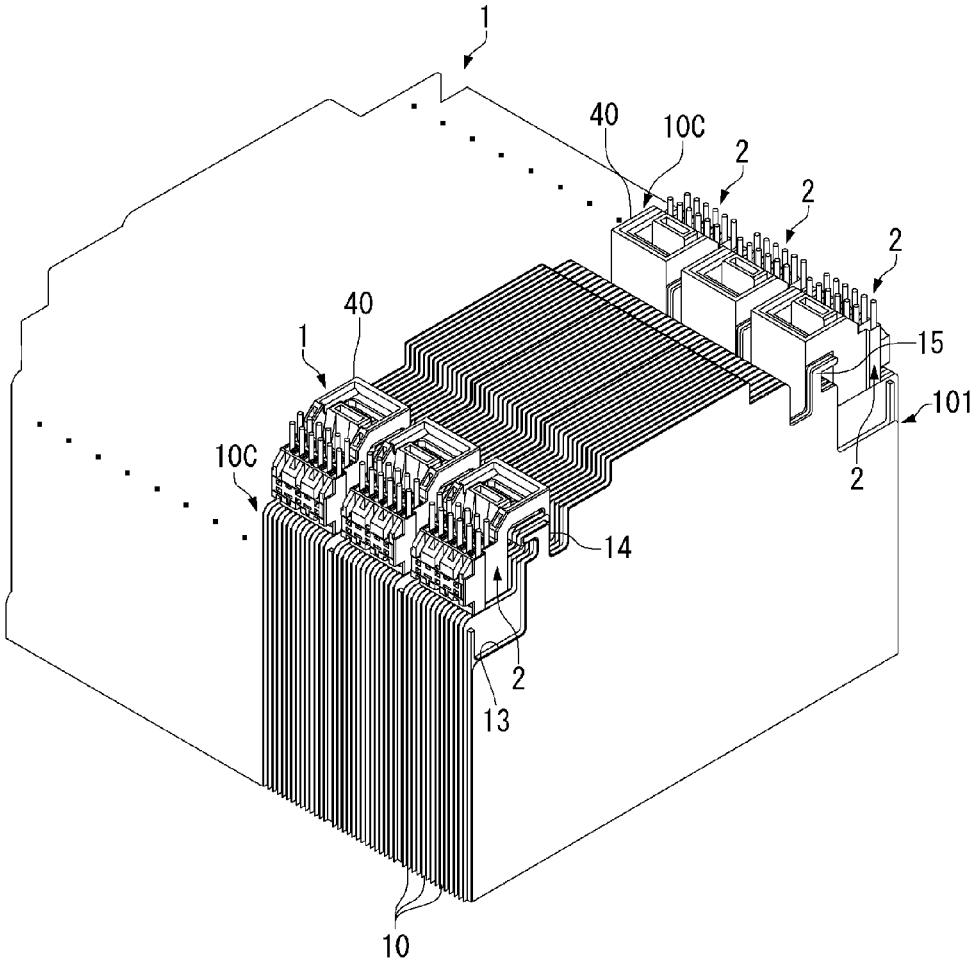
FIG. 1 is a perspective view of a connector in according to the invention that is fitted to a fuel cell.
Figure 2:
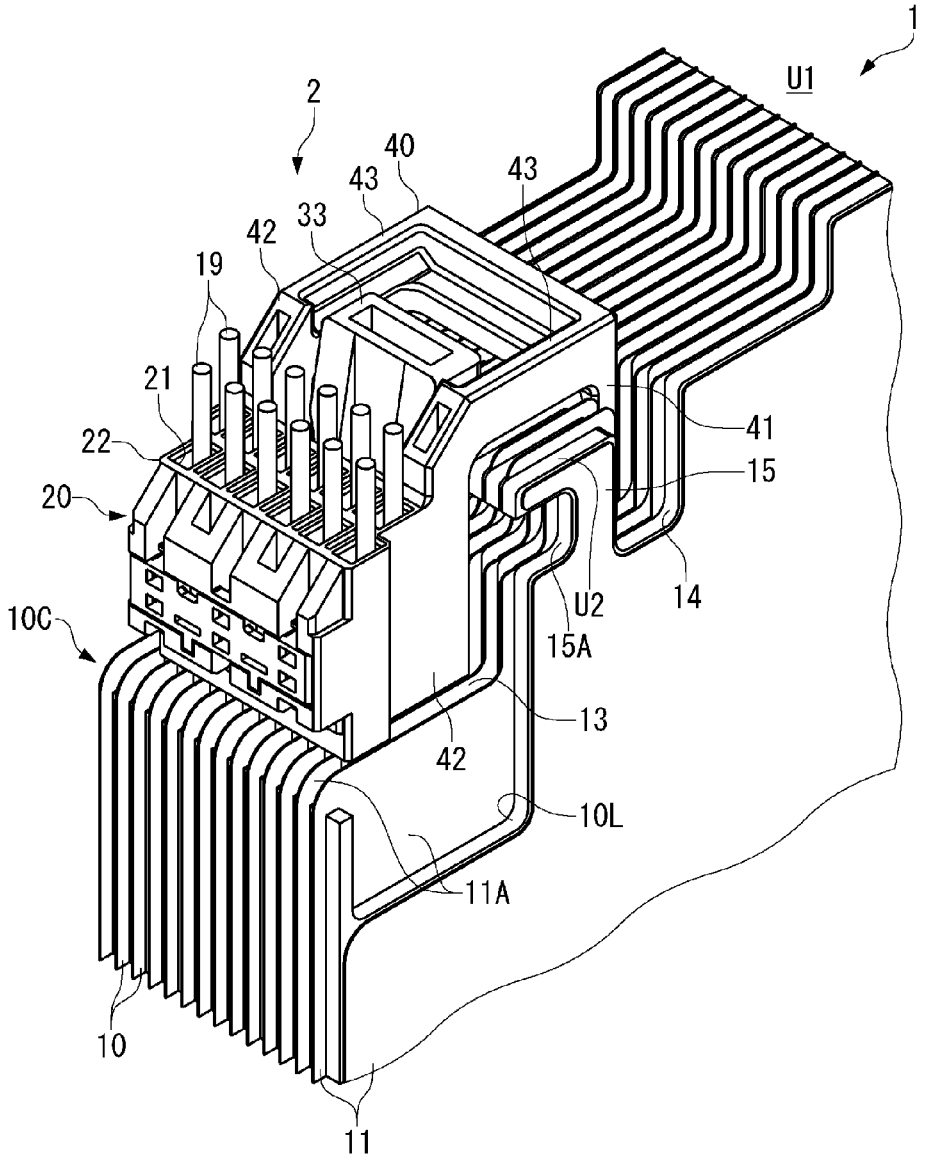
FIG. 2 is an enlarged view of a portion of the connector of FIG. 1, showing a corner part of the fuel cell and the electrical connector.

With reference to FIG. 1, a fuel cell 1 is shown that includes an electrical connector 2 according to the invention. The fuel cell further includes a plurality of flat plate-shaped cells 10 stacked at predetermined pitches, and is formed into a substantially rectangular prism form. The fuel cell 1 is connected to a control unit or an inspection system using the electrical connector 2 that causes conduction to the plurality of cells 10 all at once. This is used to control the supply amount of fuel gas and oxidant gas based on the power generating voltage of each cell 10 or to make inspection, for example, for finding a defective cell. The connector 2 is fitted to a corner part 10C of the fuel cell 1. As shown, a plurality of connectors 2 are arranged along the fuel cell 1.

Each of the cells 10 includes an electrolyte membrane, an anode provided on one surface side of the electrolyte membrane, and a cathode provided on the other surface side of the electrolyte membrane, and is formed into a substantially rectangular shape. However, the electrolyte membrane, anode, and cathode are not shown in the drawings for sake of brevity. Further, the cell 10 includes a pair of separators 11 for holding the anode and cathode there between. The cells 10 arranged adjacently use the separators 11 in common.

In order to increase power to the cell 10, the cell 10 is provided with a continuous region having a large area.

The corner part 10C to which the connector 2 is connected is offset along the width direction and the height direction of the fuel cell 1 with respect to an imaginary cell region (see also FIG. 8B, indicated by a two-dot chain line) having a rectangular shape.

The separator 11 has a passage for supplying fuel gas such as hydrogen gas to the anode and a passage for supplying oxidant gas such as oxygen gas to the cathode. This separator 11 separates the adjacent cells 10 from each other. The separator 11 extends into an L-shaped notch formed in the corner part 10C of the cell 10 (the cell 10 described herein means the electrolyte membrane, anode, and cathode), and this extending portion forms a cell electrode 11A.

The corner part 10C has a support part 13 for holding a housing 20 of the connector 2, and a fitting convex part 15 that is adjacent to the center side in the width direction of the fuel cell 1 with respect to the support part 13.

The support part 13 is formed by the cell electrode 11A, and is offset with respect to an upper surface U1 of the fuel cell 1. The offset amount from the upper surface U1 to the support part 13 is set considering a height of the connector 2.

The fitting convex part 15 protrudes beyond the support part 13. An upper surface U2 of the fitting convex part 15 is higher than the support part 13, but is offset with respect to the upper surface U1 of the fuel cell 1. The offset amount from the upper surface U1 to the upper surface U2 is set considering a height of a connecting beam 43 of the connector 2.

A locking groove 14 is formed adjacently to the fitting convex part 15. The locking groove 14 is provided so as to have a predetermined depth from the upper surface U1. This depth is set considering the height of a locking wall 41 of the connector 2 that is inserted into the locking groove 14.

The center side of the locking groove 14 is made one step lower than the upper surface U1.

Also, the fitting convex part 15 is formed with a lock groove 15A depressed from the side face on the support part 13 side toward the locking groove 14 side.

The support part 13, the locking groove 14, the fitting convex part 15, and the lock groove 15A are continuously formed along the stacking direction X of the cell 10, and all of the cells 10 have the same shape. By forming the support part 13, the locking groove 14, the fitting convex part 15, and the lock groove 15A, in the corner part 10C, the cell 10 has a shape such as to be cut along the shape of the connector 2.

Figure 3:
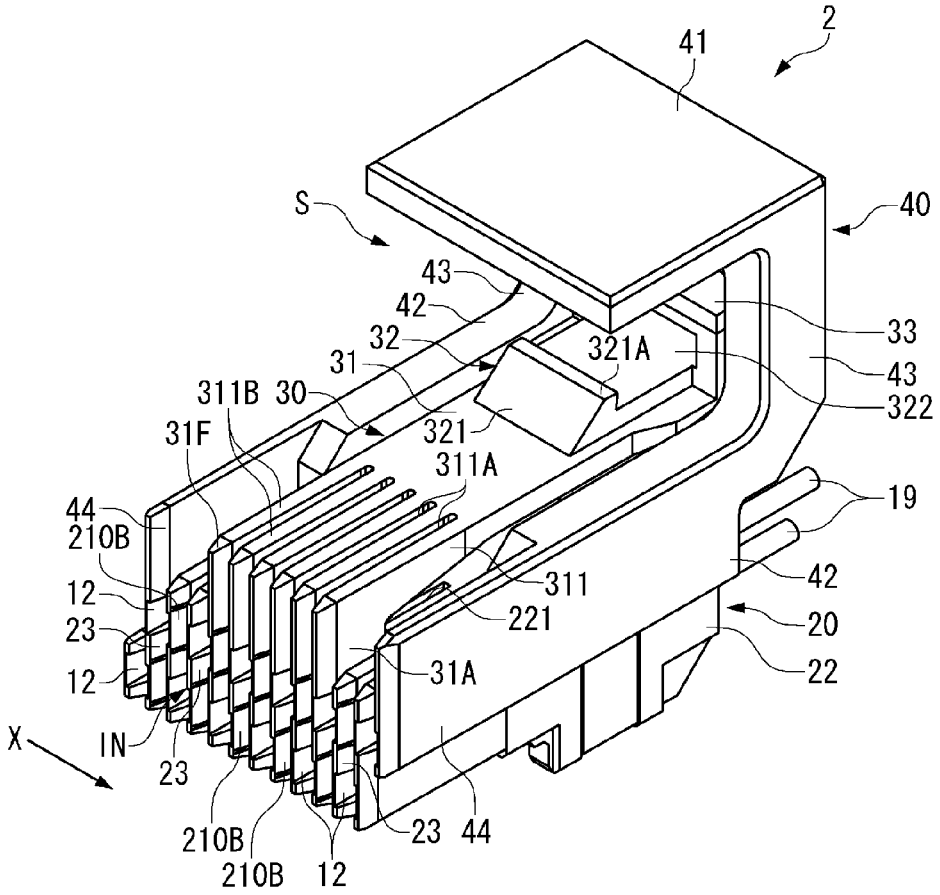
FIG. 3 is a perspective view of the connector of FIG. 1.

As shown in FIG. 3, the connector 2 includes the housing 20 for holding a plurality of contacts 12 (FIG. 4), each conducted electrically to the cell electrode 11A, and a fitting slot S located at the side of the housing 20. The fitting slot S is defined by a U-shaped fitting arm 40 formed integrally with the housing 20. An electric wire 19 connected to the contact 12 is connected to an external circuit board.

Figure 4:
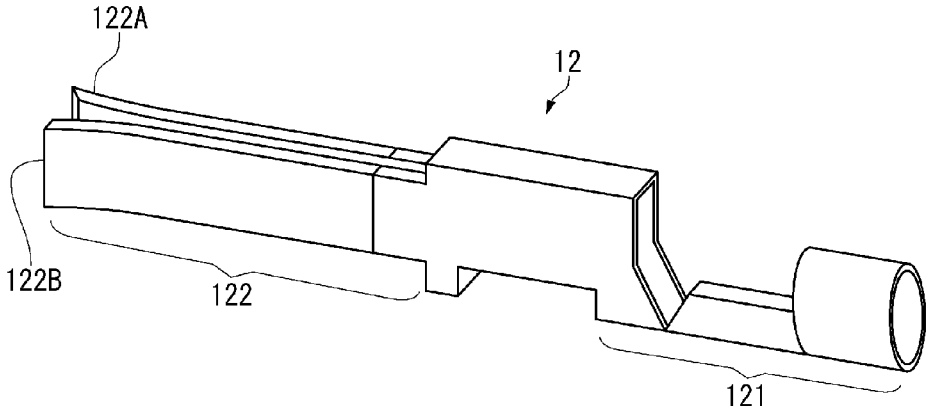
FIG. 4 is a perspective view of a contact of the FIG. 1 connector.

As shown in FIG. 4, the contact 12 is configured so as to include an electric wire mounting section 121 for connecting the electric wires 19, and a conducting section 122 connected electrically to the cell electrode 11A of the fuel cell 1.

The conducting section 122 is configured by a pair of contact parts 122A and 122B each having a thin rectangular slab form that are opposed to each other. The front end sides of the contact parts 122A and 122B are expandingly opened to the direction such that the front end sides separate from each other, so that the cell electrode 11A is led to between the contact parts 122A and 122B and is held there between.

The housing 20 includes a body 22 for holding the plurality of contacts 12 as shown in FIG. 3, and a lock 30 that is formed integrally at the side of the body 22 and is locked to the fuel cell 1.

The contacts 12 received individually in cavities 21 formed in the body 22 are arranged in two rows along the stacking direction X of the cell 10 so that the positions thereof in the row direction is alternately shifted. This arrangement prevents the contacts 12 conducted to the cell electrodes 11A arranged at narrow pitches from interfering with each other.

The detailed configuration of the body 22 will be described later.

The lock 30 has a lock arm 31 supported by the side surface portion of the body 22, a lock protrusion 32 formed on the lock arm 31, and an unlocking knob 33 communicating with the rear end side of the lock arm 31.

The lock arm 31 is a substantially plate shaped member along the side surface portion of the body 22, and a root part 31A that is thicker than the plate thickness thereof continues to the side surface portion near the front end of the body 22. A front end 31F of the root part 31A is positioned at the front-most end of the housing 20, which is almost the same position of the front end of the contact 12. A front end part 311 of the lock arm 31 including the root part 31A takes a comb-teeth shape in which a plurality of slits 311A are formed in parallel at equal intervals so as to divide the front end part 311 in the stacking direction X. Each of the slits 311A accommodates the cell electrode 11A.

The lock protrusion 32, disposed between the front end and the rear end of the lock arm 31, projects toward the fitting slot S of the lock arm 31 and may have the same width as that of the lock arm 31. The lock protrusion 32 includes a slant surface 321 located on the front end side thereof, and a step 322 that lowers to the side opposite to a top part 321A and is one step higher than the surface of the lock arm 31.

In the shown embodiment, the unlocking knob 33 is bent with respect to the rear end of the lock arm 31.

The fitting arm 40 includes connecting beams 43 that extend from the rear end side of the housing 20 toward the front side. The locking wall 41 is bent from distal ends of the connecting beams 43 toward the front end.

Plate-shaped pillars 42 are integrally provided with the body 22 face the locking wall 41. The pair of pillars 42 are integrally formed along both side surface portions of the body 22 so as to hold the lock arm 31 therebetween. Each of the pillars 42 extend from a position facing the front end part 311 of the lock arm 31 to a position facing the unlocking knob 33. A front end 42F of the pillar 42 is also positioned at the frontmost end of the housing 20.

The locking wall 41 is a plate shape in the shown embodiment and has the same width as the transverse dimension of the body 22.

The pair of connecting beams 43 correspond with the rear end side of each of the pillars 42. The unlocking knob 33 is disposed between the connecting beams 43.

In the shown embodiment, electric wires 19, jigs for wiring work, and the like are less likely to come into contact with or be caught by the lock arm 31 and the lock protrusion 32 because the lock arm 31 and the lock protrusion 32 are disposed on the inside of the fitting arm 40 of the connector 2, and thereby, protect the lock arm 31 and the lock protrusion 32 against deformation or breakage.

Further, because the connecting beams 43 of the fitting arm 40 are provided to hold the unlocking knob 33 therebetween, the unlocking knob 33 is also protected against deformation or breakage caused by an external force.

Figure 5:
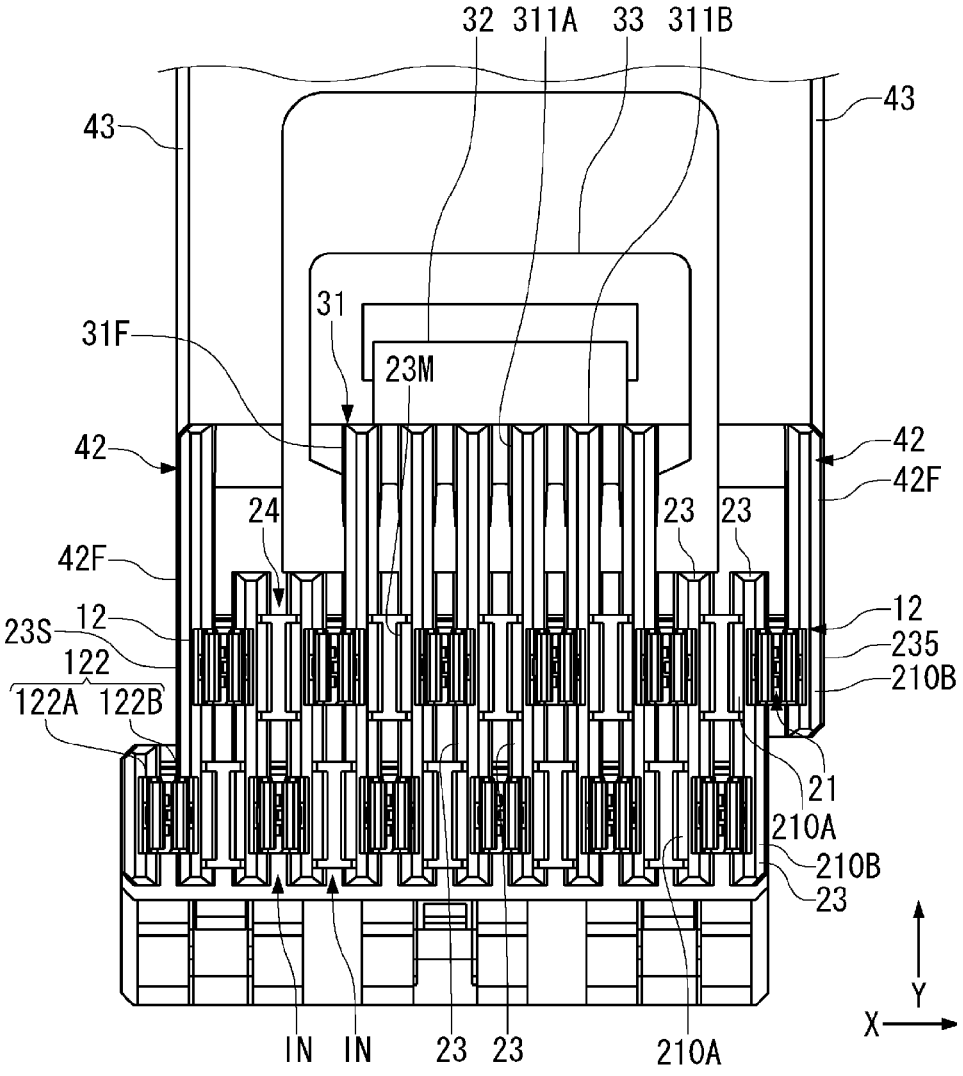
FIG. 5 is a plan view of the FIG. 1 connector showing a front end of a housing.
Figure 6:
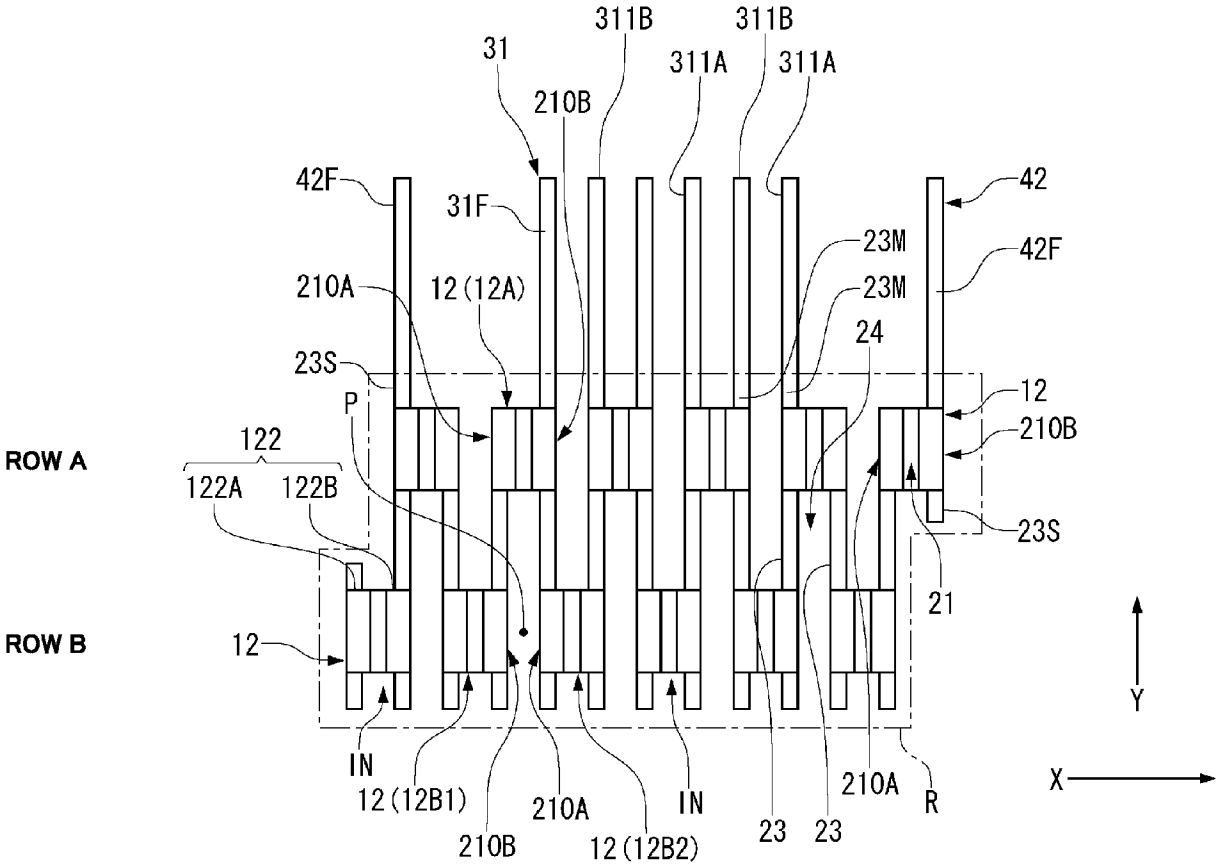
FIG. 6 is a plan view schematically showing a plurality of contacts and partition walls of the FIG. 1 connector.

Next, referring to FIGS. 5 and 6, a configuration of the contacts 12 and the periphery thereof is explained.

As described above, the contacts 12 are arranged in two rows in a zigzag formation. The paired contact parts 122A and 122B forming the conducting section 122 are opposed to each other in the row direction (X direction). Taking the two rows of the contacts 12 as row A and row B, an opening is disposed between the contact parts 122A and 122B along the longitudinal direction Y connecting any one contact 12A of row A to a position P between two contacts 12B1 and 12B2 of row B adjacent to the contact 12A. The body 22 includes an insertion port IN, which passes between the contact parts 122A and 122B, along the longitudinal direction Y, and the cell electrode 11A is inserted into the insertion port IN. In the shown embodiment, the insertion port IN is a slit 221 on both sides in the longitudinal direction of the body 22 (FIG. 3).

A pair of lower walls 210A and 210B are provided along the front end of the body 22, which extend in the depth direction of the contact 12, with a space corresponding to the width of the insertion port IN being provided, to form the front end side of the cavity 21.

In FIG. 6, since the lower walls 210A and 210B sit on the contact 12 and do not appear, the positions thereof are indicated by arrow marks. Between the lower walls 210A and 210B, the contact 12 is held. The front ends of the lower walls 210A and 210B face to the front ends of the contact parts 122A and 122B.

The lower wall 210A for holding the contact part 122A of any one contact 12A of row A and the lower wall 210B for holding the contact part 122B of the contact 12B1 of row B adjacent to the contact 12A are positioned on almost the identical straight line. Similarly, the lower wall 210B and the lower wall 210A are positioned on almost the identical straight line.

As described above, the cavities 21 of row A and the cavities 21 of row B are arranged repeatedly in the row direction.

The same number of cavities 21 are arranged in both row A and row B, and a plan region R in which the cavities 21 are arranged has a shape such that the row A side projects beyond the row B side on one end side in the row direction of the body 22, and the row B side projects beyond the row A side on the other end side. The body 22 has a shape corresponding to the shape of the plan region R, and one side surface portion of the body 22 has a level difference shape such as to project on the row A side, and the other side surface portion thereof has a level difference shape such as to project on the row B side. By combining these level differences alternately, the contact to all cells 10 is made by the plurality of connectors 2.

The body 22 includes a plurality of partition walls 23 in parallel to each other along the longitudinal direction Y perpendicular to the directions of row A and row B. Each of the partition walls 23 erects to the same height as the heights of the lower walls 210A and 210B in the depth direction of the contact 12 like the lower walls 210A and 210B.

The lower wall 210A of the contact 12A of row A and the lower wall 210B of the contact 12B1 of row B are connected to each other by the partition wall 23. These lower walls 210A and 210B and the partition wall 23 are integrally formed in the shown embodiment. Similarly, the lower wall 210B and the lower wall 210A are connected to each other. These lower walls 210A and 210B and the partition wall 23 are integrally formed. If the lower walls 210A and 210B are integrated using the partition wall 23 as described above, the rigidity is improved as compared with single lower walls 210A and 210B.

A contact receiving space 24 is formed between the adjacent partition walls 23, a. The contact receiving space 24 forms the insertion port IN.

Figure 7:
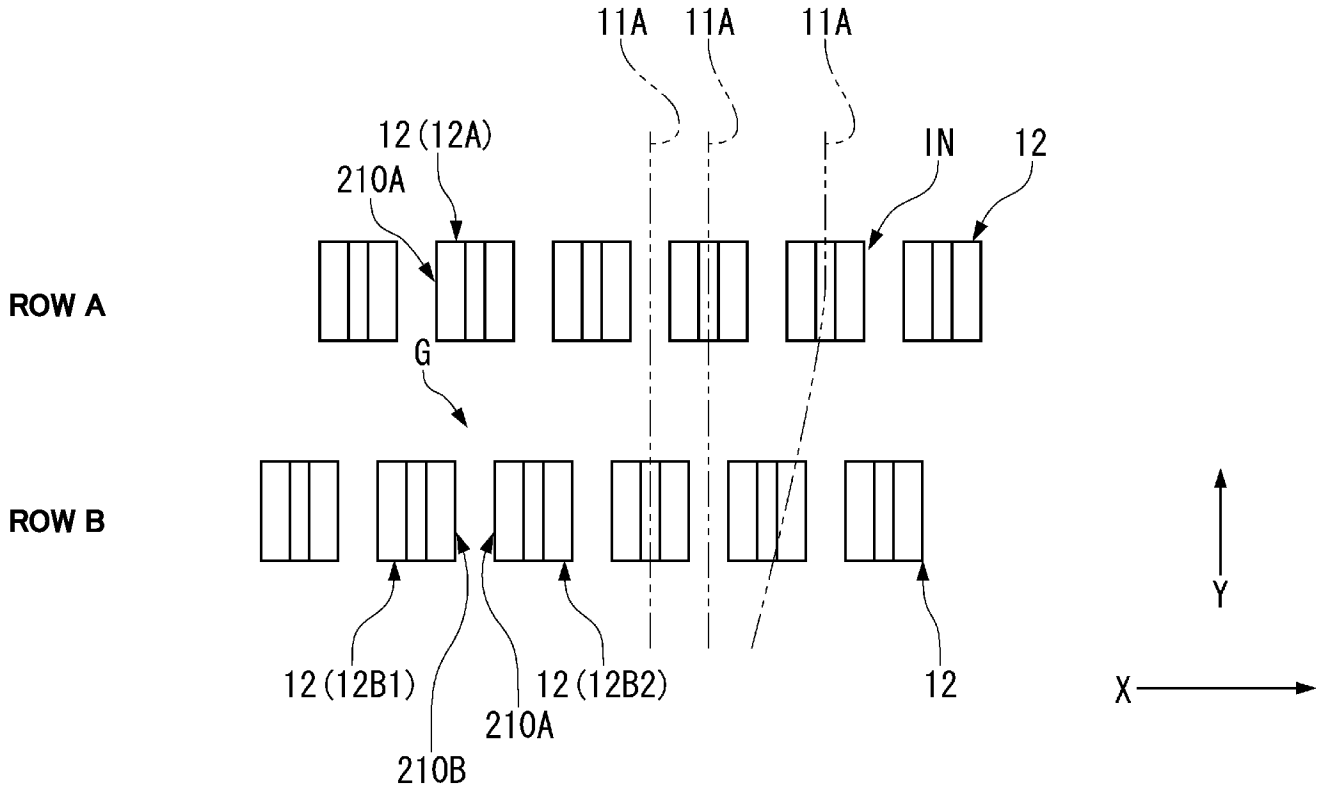
FIG. 7 is a plan view showing a comparative example of FIG. 6.

If the above-described partition wall 23 is not formed, as shown in FIG. 7, a gap G is formed between the contact 12 of row A and the contact 12 of row B. Therefore, when fitting is performed, a slightly deflecting cell electrode 11A (indicated by two-dot chain line in FIG. 7) may be inserted into the insertion port IN of the contact 12 of the adjacent row of the contact 12 to which the cell electrode 11A is to be normally fitted.

In the shown embodiment, however, because the posture of the cell electrode 11A is corrected by the partition wall 23, the cell electrode 11A is fitted to the normal contact 12.

As described above, the partition wall 23 prevents the cell electrode 11A from being fitted mistakenly to the contact of the adjacent row at a distance between the contacts 12 close to each other of row A and row B. For this purpose, the partition wall 23 is formed to have a length sufficient to prevent the cell electrode 11A from being positioned between row A and row B, and a gap may be provided between the lower walls 210A and 210B and the partition wall 23.

The partition wall 23 is formed not only between row A and row B but also throughout, from one end portion to the other end portion in the longitudinal direction Y of the plan region R in which the contacts 12 are disposed.

Further, the partition walls 23 (23S) located on both end sides of the body 22 extend to the front ends 42F of the pillars 42 of the fitting arm 40, and are formed integrally with the pillars 42, and also the partition wall 23 (23M) located in the central portion extends to the front end 31F of the comb-teeth shape of the lock arm 31, and are formed integrally with the lock arm 31. The partition walls 23 between the partition wall 23S and the partition wall 23M project slightly from the body 22 toward the locking wall 41 (FIG. 3) side of the fitting arm 40.

The front ends 42F of the pillars 42 and the front end 31F of the lock arm 31 are positioned on the extensions of the partition walls 23, and, together with the partition walls 23, correct the postures of the cell electrodes 11A when fitting is performed.

The slits 311A of the lock arm 31 are located on the extensions of the contact spaces 24, and on the extensions of the partition walls 23, thickness parts 311B of the front end part 311 of the lock arm 31 are located.

The front end part 311 is supported on the body 22 by means of the thickness parts 311B, and accommodates the cell electrodes 11A by means of the slits 311A.

If the slits 311A are not formed, the front end of the lock arm 31 must be inevitably disposed above the upper end of the cell electrodes 11A (on the rear side of the connector 2) to avoid the interference with the cell electrodes 11A. Thereby, the length of the lock arm 31 is made short, and the deflection amount of the lock arm 31 may be decreased, and the lock may be made insufficient. To avoid this phenomenon, if the lock arm 31 is extended to the rear by the lengths of the slits 311A, the connector 2 becomes undesirably tall.

In contrast, in the shown embodiment, because the front end part 311 of the lock arm 31 is formed with the slits 311A in which the cell electrodes 11A are received, the front end of the lock arm 31 can be positioned at a further front position. Thus, even if the lock arm 31 does not extend to the rear, the length of the lock arm 31 necessary for obtaining the same amount of deflection can be assured.

Figure 8B:
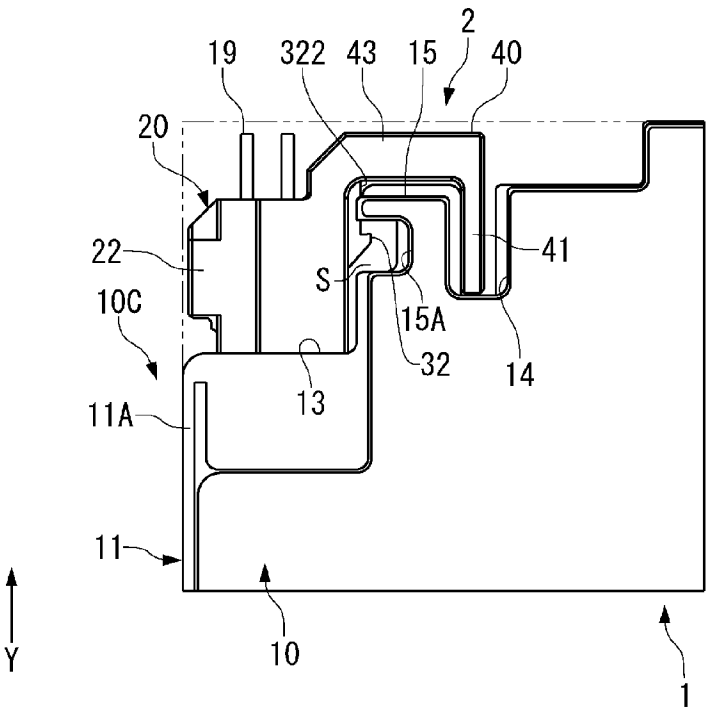
FIGS. 8A and 8B are side views showing a procedure for fitting the FIG. 1 electrical connector to a fuel cell.
Figure 8A:
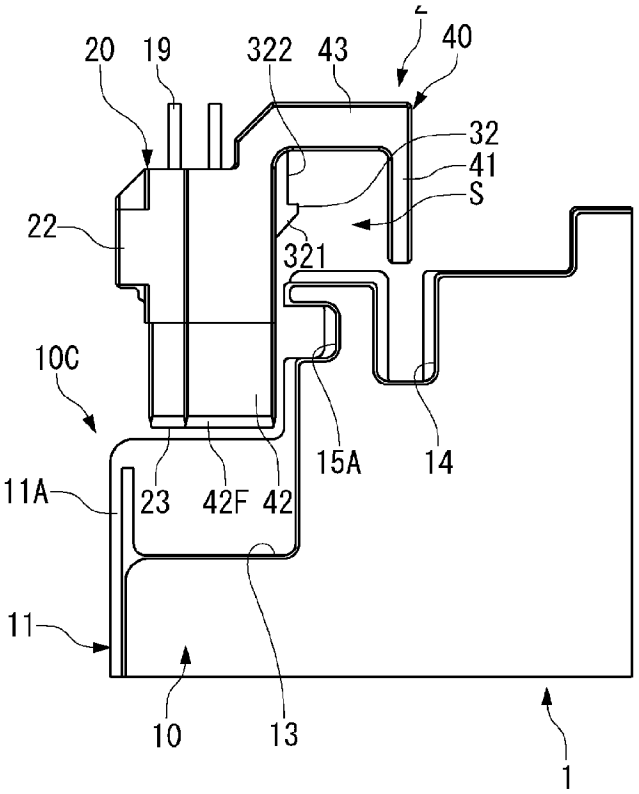

When the connector 2 is fitted to the fuel cell 1, as shown in FIG. 8A, the connector 2 is brought close to the corner part 10C of the fuel cell 1. At this time, the connector 2 is positioned with respect to the fuel cell 1 so that the fitting convex part 15 fits in the fitting slot S with the front ends of the pillars 42 and the front end of the lock 30 being a guide for the positioning. Thereafter, the connector 2 is pushed in toward the fuel cell 1.

At this time, the front ends 42F of the pillars 42, the front end 31F of the lock arm 31, and the partition walls 23 serve as guides for the cell electrodes 11A, and the cell electrodes 11A positioning is corrected to the longitudinal direction Y perpendicular to the stacking direction X. Therefore, the cell electrodes 11A are inserted straight into the insertion ports IN of the contacts 12 to be fitted normally.

When the fitting convex part 15 is fitted beyond the fitting slot S on the inside of the fitting arm 40 as shown in FIG. 8B, the locking wall 41 of the fitting arm 40 is inserted into the locking groove 14 of the fuel cell 1.

In the above-described process, the slant surface 321 of the lock protrusion 32 comes into contact with the fitting convex part 15 and is pushed by it, and thereby the lock arm 31 deflect in a counterclockwise direction, as shown in FIG. 8A. When the connector 2 is further pushed down, and the lock protrusion 32 fits to the lock groove 15A, deflection of the lock arm 31 is restored. Because the step 322 of the lock protrusion 32 abuts against the side surface of the fitting convex part 15, backlash of the connector 2 is restrained.

When the connector 2 is unlocked with the fuel cell 1, by pressing the unlocking knob 33 in the clockwise direction in FIG. 8B, the lock protrusion 32 comes off the lock groove 15A, so that the connector 2 can be removed toward the upside of the fuel cell 1.

According to the shown embodiment, when the connector 2 is fitted to the fuel cell 1 in which the plurality of cells 10 are arranged, improper positioning can be prevented by reliably causing each of the cell electrodes 11A of the cells 10 to correspond to each of the contacts 12 one-to-one.

In addition, because the lower walls 210A and 210B forming the cavity 21 are connected using the partition wall 23, strength can be improved.

Moreover, because the front end part 311 of the lock arm 31 includes the slits 311A in which the cell electrodes 11A are received, and the front end part 311 of the lock arm 31 can be located at a position lower than the upper ends of the cell electrodes 11A, the length of the lock arm 31 necessary for stress distribution of the lock arm 31 and assurance of locking can be assured while the size of the connector 2 is kept small. Thereby, the cost can be reduced by the smaller size of the connector 2 while the reliability is improved.

Figure 9:
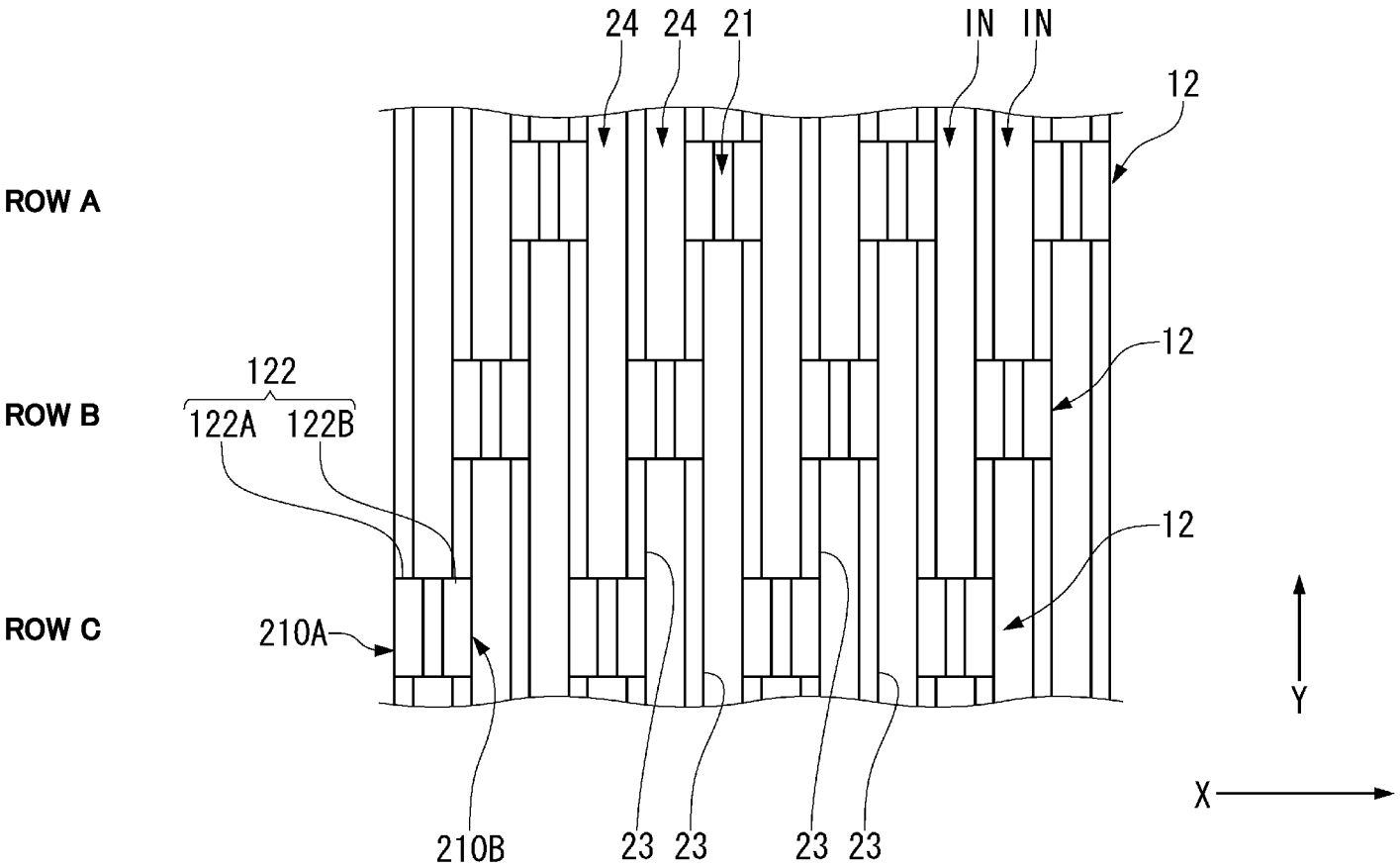
FIG. 9 is a schematic view showing a contacts arranged in a modified formation of a connector according to the invention.

One skilled in the art should appreciate that the number of rows of the contacts 12 is optional. For example, as shown in FIG. 9, the described embodiment can also be applied to a configuration in which the contacts 12 are arranged in a zigzag form in three rows of row A, row B, and row C.

The connector according to the invention can be used for different usages, not only a fuel cell, but also a bus bar and a structure in which flat plate-shaped members are arranged in parallel.

The connector according to the in invention is not limited to a connector provided with the fitting arm 40, but may be a connector fitted to a fitting opening formed in a mating structure.

Besides the above description, the configurations described in the above embodiment can be selected or changed as appropriate to other configurations without departing from the spirit and scope of the present invention.

What is claimed is:

1. An electrical connector comprising;

a housing having a partition wall;

a plurality of contacts alternatively arranged along a plurality of rows in the housing such that adjacent rows of the plurality of rows are separated by the partition wall and offset with respect to each other; and a lock having a lock arm with a plurality of slits positioned at a front end thereof and being supported by the housing.

2. The electrical connector according to claim 1, wherein the lock arm is supported by a side surface portion of the housing.

3. The electrical connector according to claim 2, wherein the lock arm extends from a front of the housing.

4. The electrical connector according to claim 2, wherein the lock arm is integrally formed with the housing.

5. The electrical connector according to claim 1, wherein the lock arm is comb shaped.

6. The electrical connector according to claim 3, wherein the lock further includes a lock protrusion formed on the lock arm and having a slant surface located on a front end thereof.

7. The electrical connector according to claim 6, wherein the lock protrusion further includes a step having a planar surface stepped between a top part of the slant surface and a top surface of the lock arm.

8. The electrical connector according to claim 3, wherein the lock further includes an unlocking knob extending from a rear end of the lock arm.

9. The electrical connector according to claim 1, further comprising a fitting slot disposed along a rear of the housing.

10. The electrical connector according to claim 9, wherein the fitting slot is defined by a fitting arm.

11. The electrical connector according to claim 10, wherein the fitting arm is U-shaped.

12. The electrical connector according to claim 10, wherein the fitting arm includes a connecting beam that extends from the rear side and a locking wall bent from a distal end of the connecting beam.

* * * * *